United States Patent [19]

Morel

[11] 4,041,984

[45] Aug. 16, 1977

[54] JET-DRIVEN HELMHOLTZ FLUID OSCILLATOR

[75] Inventor: Thomas Morel, Birmingham, Mich.

[73] Assignee: General Motors Corporation, Detroit, Mich.

[21] Appl. No.: 701,537

[22] Filed: July 1, 1976

[51] Int. Cl.[2] ..... F15D 1/08

[52] U.S. Cl. ..... 137/842; 137/60 A

[58] Field of Search ..... 137/806, 822, 826, 842, 137/60 A, 828; 116/65, 137 R

[56] References Cited

U.S. PATENT DOCUMENTS

| | | | |
|---|---|---|---|
| 3,398,758 | 8/1968 | Unfried | 116/137 R |
| 3,432,804 | 3/1969 | Becken | 137/842 |
| 3,643,431 | 2/1972 | Jamieson | 137/842 X |
| 3,651,639 | 2/1972 | Black | 137/842 X |
| 3,735,778 | 5/1973 | Garnier | 137/604 |
| 3,855,859 | 12/1974 | Adams | 137/842 X |

*Primary Examiner*—William R. Cline
*Attorney, Agent, or Firm*—Donald F. Scherer

[57] ABSTRACT

A jet-driven Helmholtz fluid oscillator having two openings located coaxially in opposite walls of a chamber. A fluid jet enters through one opening, the inlet, at a constant flow rate and exits through the other opening, the outlet, at a pulsating or oscillating flow rate. The pressure level within the chamber also fluctuates. All critical dimensions of the oscillator are subject to geometrical similarity and scale with the diameter of the inlet. The inlet flow rate is proportional to the Helmholtz frequency of the chamber and the jet length within the chamber. The outlet fluid flow and the chamber pressure oscillate at substantially the same frequency as the Helmholtz frequency.

1 Claim, 2 Drawing Figures

JET-DRIVEN HELMHOLTZ FLUID OSCILLATOR

This invention relates to pure fluid devices and more particularly to pure fluid devices providing an oscillating output generated from a constant input.

It is an object of this invention to provide an improved fluid oscillator having a substantially constant flow input and an oscillating flow output.

Another object of this invention is to provide an improved jet-driven Helmholtz fluid oscillator having aligned input and output openings separated by a chamber having a certain Helmholtz frequency which depends on the chamber geometry, wherein a constant flow input results in oscillating flow output at a frequency close to the Helmholtz frequency and wherein the pressure in the chamber fluctuates at the same frequency.

A further object of this invention is to provide an improved jet-driven Helmholtz fluid oscillator having coaxially aligned input and output openings which are separated by a chamber wherein the dimensions of the output opening, the distance between the openings and the volume of the chamber scale with the inlet opening dimension, and wherein the chamber has a Helmholtz frequency so that a constant input flow proportional to the Helmholtz frequency and the jet length results in an oscillating output flow and pressure fluctuation within the chamber, at approximately the Helmholtz frequency.

These and other objects and advantages will be more apparent from the following description and drawings in which.

Figure 1:
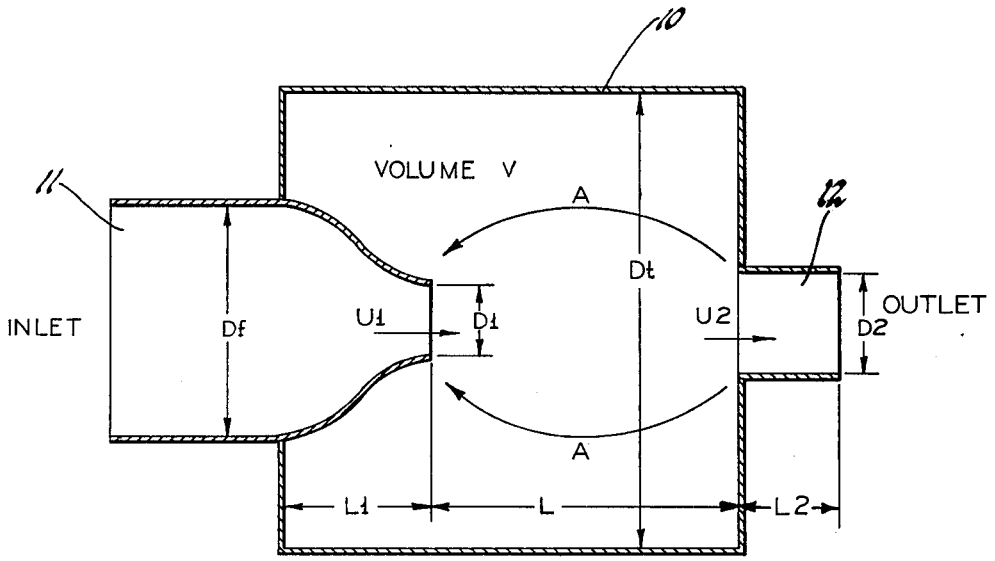
FIG. 1 is a diagrammatic representation of one embodiment of the invention.

Referring to the drawing, wherein like characters represent the same or corresponding parts there is shown in FIG. 1 a chamber 10 having an inlet 11 and an outlet 12. The inlet 11 protrudes into the chamber a nozzle protrusion distance L1. The inlet 11 has a large diameter portion Df which converges to a small diameter opening D1. The contour of the inlet 11 is preferably smooth from Df to D1. The inlet 11 is also coaxially aligned with the outlet 12 which has a diameter D2 and a length L2. The distance or jet length from the edge of diameter D1 to the outlet 12 is designated L.

The chamber 10 is cylindrical having a diameter Dt which is considerably larger than the inlet diameter D1. The chamber 10 has a volume V which is proportional to its length and a square of its diameter. It is well known that a chamber, such as 10, can act as a Helmholtz resonator and accordingly has a natural or Helmholtz frequency fo.

The inlet 11 is, during operation, connected to a source of constant fluid flow such as a conventional pump and accumulator, not shown, such that the fluid flowing into chamber 10 through the inlet 11 has a constant velocity designated U1 at the diameter D1. As the fluid enters the chamber 10 through diameter D1 it continues towards the outlet 12. However, as the fluid leaves diameter D1 a vortex ring starts to develop which eventually has a mean diameter greater than diameter D2 of the outlet 12, and so a portion of the fluid strikes the end chamber 10 surrounding outlet 12. A pressure wave is generated at the outlet which then travels in the direction of arrows A toward the inlet 11 at the speed of sound in the fluid. Since the vortices are not continuous, that is they are spaced during their travel from D1 to D2, the changes in energy level of the jet stream will fluctuate. As the increases in energy level reach the outlet 12, the outlet flow will increase and vice versa. Thus the outlet flow U2 is a fluctuating flow. The pressure within the chamber 10 also fluctuates.

It has been found that when one gradually increases the jet velocity one encounters regions where large flow and pressure oscillations are observed. The oscillations occur at a frequency which is slightly higher than the Helmholtz frequency of the chamber when no flow is present (fo). It has also been found that the oscillator exhibits a plurality of modes during which the flow and pressure oscillations have local maxima. Between these modes, the chamber 10 is relatively quiet and stable from a flow and pressure standpoint. The operating modes at which maximum flow and pressure fluctuations were observed have been found to occur at discrete values of a dimensionless quantity called the Strouhal Number. The Strouhal number is a dimensionless quantity, well known in physics, which occurs in fluid flow systems. In the particular system described the Strouhal number is proportional to the average number of vortex rings traveling between the inlet and outlet and also proportional to the ratio of the convection velocity of the vortex rings to the jet velocity $U_1$. The convection velocity of the vortex rings is the velocity at which the vortex rings travel from the inlet diameter D1 to the outlet diameter D2. The oscillations thus occur if the inlet jet velocity $U_1$, is maintained slightly above the value given by the product of the Helmholtz frequency fo and of the jet length L, divided by one of the discrete values of the Strouhal number.

It has been found that the dimensions of the chamber 10 can be maintained in proportion to the inlet diameter D1 within described ranges to define a jet driven Helmholtz oscillator which will produce the desired pressure and flow oscillations. These relationships are as follows:

$D2/D1 = (1. - 2.1)$ D1 is (25.4 - 200 mm)
$V/D1^3 = (14 - 350)$ $L/D1 = (0.5 - 7)$
$L1/D1 = (0 - 2)$ $Df/D1 = (2.5 - 10)$
$L2/D1 = (0 - 7)$ $Dt/D1 = (4 - 8)$

Jet driven Helmholtz oscillators can be used for sound generation in that they produce a loud tone, sound source of a given frequency, of a sonic warning device to indicate that a jet velocity has reached a certain level. Helmholtz oscillators can also be used as a jet mixing device such as a jet pump or a continuous combustor. They can also be used as a source of pulsating jet flow to establish liquid droplet break-up such as in a fuel atomizer.

Any oscillator constructions to the following dimensions will provide a sound source generator in accordance with the present invention. D1=25.4mm (1"), L1=2D1, L=2D1, D2=1.4D1, L2=0.5D1, Dt=6D1 and Dt=2.5D1. A Helmholtz oscillator with the above dimensions having a constant fluid inlet velocity of 23 meters per second at D1 will produce a strong sound level having a frequency of 247 Hz.

Figure 2:
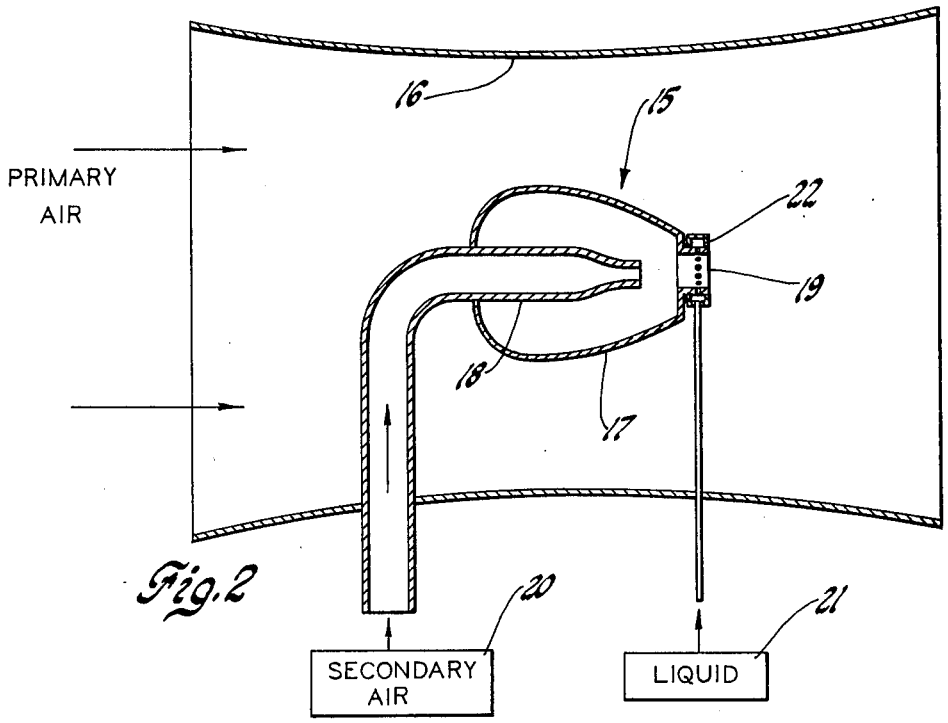
FIG. 2 is a diagrammatic representation of another embodiment of the invention.

FIG. 2 shows a Helmholtz oscillator 15 disposed in the venturi 16 of an otherwise conventional fuel atomizer. The oscillator 15 has a chamber 17 into which an inlet nozzle 18 protrudes which nozzle is coaxially aligned with an outlet 19. The inlet nozzle is in communication with a source of air 20 which delivers air flow at a constant rate to the nozzle 18. The outlet 19 is in fluid communication with a source of liquid 21, such as a fuel pump. The liquid fuel from source 21 is delivered through an annular chamber 22 such that the liquid enters the outlet 19 at the periphery thereof. As the fluctuating exit flow passes through outlet 19, it assists in atomizing the liquid from source 21 to provide a better mixing of the fuel with the primary air flowing into the venturi. The primary air flow is controlled by a conventional throttle plate or valve, not shown.

Obviously, many modifications and variations are possible in light of the above teaching. It is, therefore, to be understood that within the scope of the appended claims the invention may be practiced otherwise than is specifically described.

What is claimed is:

1. A jet-driven Helmholtz fluid oscillator comprising: a fluid inlet nozzle having a feed duct opening of diameter Df and an inlet opening of diameter D1; a fluid outlet coaxially aligned with said inlet and having an opening of diameter D2 and a length L2; and a chamber disposed between said inlet and outlet having a volume V, a jet length L measured from the inlet opening to the fluid outlet end of said chamber, a nozzle protrusion length L1 measured from the fluid inlet end of said chamber to the inlet opening and a diameter Dt, wherein D1 is within the range of 25.4 mm to 200 mm, the ratio D2/D1 is within the range 1.0 to 2.1, the ratio L2/D1 is within the range 0–7.0, the ratio L/D1 is within the range 0.5 to 7.0, the ratio $V/D1^3$ is within the range 14 to 350, the ratio Df/D1 is within the range 2.5 to 10.0, the ratio L1/D1 is within the range 0 to 2.0 and the ratio Dt/D1 is within the range 4.0 to 8.0, said chamber having a Helmholtz frequency fo whereby when a fluid at a constant flow rate slightly larger than the product Lfo divided by a dimensionless frequency known as the Strouhal number is introduced at the fluid inlet, the fluid will be discharged from the outlet in a fluctuating manner to produce fluid flow and chamber pressure oscillations at a frequency slightly higher than the Helmholtz frequency which would be present with no flow.

* * * * *